US006790338B2

(12) United States Patent
Kinstle et al.

(10) Patent No.: US 6,790,338 B2
(45) Date of Patent: Sep. 14, 2004

(54) ELECTROLYTIC PROCESS FOR PREPARING METAL SULFONATES

(75) Inventors: George P. Kinstle, Hinckley, OH (US); Alex T. Magdics, Highland Hts., OH (US); Thomas E. Nappier, Rocky River, OH (US)

(73) Assignee: OM Group, Inc., Cleveland, OH (US)

( * ) Notice: Subject to any disclaimer, the term of this patent is extended or adjusted under 35 U.S.C. 154(b) by 0 days.

(21) Appl. No.: 10/315,755

(22) Filed: Dec. 6, 2002

(65) Prior Publication Data

US 2004/0110987 A1 Jun. 10, 2004

(51) Int. Cl.[7] ..... C25B 3/00

(52) U.S. Cl. ..... 205/457; 205/458; 205/445; 205/455

(58) Field of Search ..... 205/457, 458, 205/445, 455

(56) References Cited

U.S. PATENT DOCUMENTS

| | | | | |
|---|---|---|---|---|
| 4,330,377 A | | 5/1982 | Franks, Jr. | 204/93 |
| 5,162,555 A | | 11/1992 | Remmers et al. | 556/85 |
| 5,491,247 A | | 2/1996 | Gernon | 556/113 |
| 5,618,404 A | * | 4/1997 | Okuhama et al. | 205/445 |
| 6,197,186 B1 | * | 3/2001 | Guhl et al. | 205/457 |
| 6,242,624 B1 | | 6/2001 | Yoshioka et al. | 556/85 |
| 6,428,676 B1 | * | 8/2002 | Onuoha | 205/478 |

FOREIGN PATENT DOCUMENTS

WO 85/03530 8/1985

OTHER PUBLICATIONS

Journal of Applied Electrochemistry 31 693–702, 2001. "Electrochemical Dissolution of Tin in Methanesulphonic Acid Solutions".

Inorganic Chemistry, vol. 3, No. 7, Jun. 29, 1964. "The Anodic Dissolution of Tin".

* cited by examiner

*Primary Examiner*—Arun S. Phasge
(74) *Attorney, Agent, or Firm*—Renner, Otto, Boisselle & Sklar, LLP

(57) ABSTRACT

A method for preparing metal salts of organic sulfonic acids such as tin alkane sulfonates by electrolysis is described. The method comprises:

(A) providing a membraneless electrolytic cell having an upper section and a lower section, and comprising:
  (i) a metal anode positioned in the lower section of the electrolytic cell, and
  (ii) a cathode positioned in the upper section of the electrolytic cell, (B) charging to the cell, an aqueous solution of an organic sulfonic acid, (C) passing a current through the cell whereby the metal of the anode dissolves in the sulfonic acid and forms the desired metal sulfonate, (D) accumulating the metal sulfonate in a lower portion of the lower section of the cell, and (E) recovering an aqueous solution of the desired metal sulfonate from the lower portion of the lower section of the cell.

28 Claims, 1 Drawing Sheet

ELECTROLYTIC PROCESS FOR PREPARING METAL SULFONATES

FIELD OF THE INVENTION

This invention relates to a method of preparing metal sulfonates by electrolysis utilizing a membraneless electrolytic cell.

BACKGROUND OF THE INVENTION

Aqueous solutions of certain metal sulfonates are used, for example, for the electrolytic or currentless deposition of metal or metal alloys, for electrolytic coloring of aluminum and aluminum alloys, and in electrical batteries.

In the electronic industry today, tinning or solder plating is utilized for pre-coating electronic components to enhance their solderability. Aqueous plating baths containing fluoborates have been used widely to permit high-speed uniform metal plating of metals such as tin, lead, or tin-lead alloys. However, the baths containing fluoborates generally are quite corrosive and toxic requiring special equipment which is expensive and presents difficulties in operation including the disposal of the waste water. More recently, the baths containing fluoborates are being replaced by baths containing an alkyl sulfonic acid and a tin alkyl sulfonate, lead, alkyl sulfonate, or mixtures thereof. Thus, there is a need for the effective production of various metal salts of organic sulfonic acids such as methane sulfonate, particularly solutions of metal sulfonates containing from 15 to 30% by weight of the metal sulfonate.

SUMMARY OF THE INVENTION

In one embodiment, the invention is a method for preparing a metal sulfonate by electrolysis which comprises:

(A) providing a membraneless electrolytic cell having an upper section and a lower section, and comprising:
  (i) an anode comprising at least one metal positioned in the lower section of the electrolytic cell, and
  (ii) a cathode positioned in the upper section of the electrolytic cell (B) charging to the cell, an aqueous solution of an organic sulfonic acid, (C) passing a current through the cell whereby the metal of the anode dissolves in the sulfonic acid and forms the desired metal sulfonate, (D) accumulating the metal sulfonate in a lower portion of the lower section of the cell, and (E) recovering an aqueous solution of the desired metal sulfonate from the lower portion of the lower section of the cell.

A variety of metal salts of various sulfonic acids can be prepared by the method of the invention. In one embodiment, the metals are selected from precious metals, copper, nickel, zinc, lead and tin.

DESCRIPTION OF THE EMBODIMENTS

Figure 1:
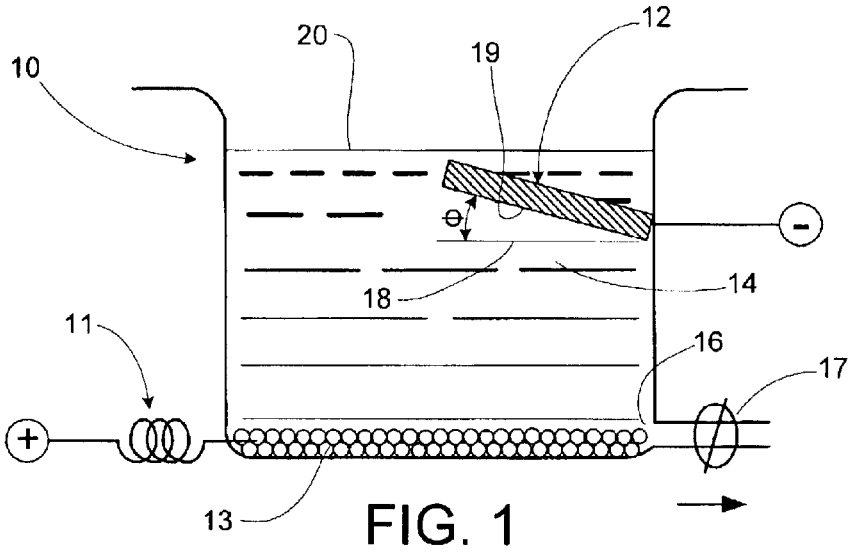
FIG. 1 is a schematic cross-section of an electrolytic cell useful in performing the method of the invention.

The present invention relates to a method of preparing metal salts of organic sulfonic acids, and more particularly, to a method of preparing aqueous solutions of metal salts of organic sulfonic acids. In one embodiment, the invention provides a method for the production and recovery of concentrated aqueous solutions of the metal sulfonates without the need for subsequent concentration steps. Thus, in one embodiment, the method of the present invention provides a process for preparing aqueous solutions of metal sulfonates containing from about 40% to about 70% by weight of the metal sulfonate. In another embodiment, the concentration of the metal sulfonate and the recovered solutions may range from about 50 to about 65% by weight.

In one embodiment, the method of the present invention for preparing metal salts of organic sulfonic acids by electrolysis comprises:

(A) providing a membraneless electrolytic cell having an upper section and a lower section, and comprising:
  (i) a metal anode positioned in the lower section of the electrolytic cell, and
  (ii) a cathode positioned in the upper section of the electrolytic cell, (B) charging to the cell, an aqueous solution of an organic sulfonic acid, (C) passing a current through the cell whereby the metal of the anode dissolves in the sulfonic acid and forms the desired metal salt, (D) accumulating the metal salt in a lower portion of the lower section of the cell, and (E) recovering an aqueous solution of the desired metal salt from the lower portion of the lower section of the cell.

The term upper section is intended to refer to approximately the upper half of the cell, and the term lower section refers to approximately the lower half of the cell.

An electrolytic cell which can be utilized for carrying out this embodiment is illustrated in FIG. 1 wherein there is illustrated an electrolytic cell 10 which contains metal fragments 13 positioned in the lower portion of the lower section of cell 10. The fragments are connected to a power source by wire 11 and thus function as the anode. The cell also contains cathode 12 positioned in the upper section of cell 1 and submerged in the solution 14. The cathode 12 is illustrated in FIG. 1 as being positioned at an angle θ formed by horizontal line 18 and the bottom surface 19 of cathode 12. Horizontal line 18 is shown parallel to the surface 20 of the solution 14 in the cell 10. This angle provides a convenient path for the hydrogen gas which is generated at the cathode 12 to exit the cell without accumulating and/or causing unnecessary mixing of the solution within the cell 10. The angle θ may range from about 0° to about 30° or from about 5' to 20°. In one embodiment the angle is about 10°. Cell 10 also is provided with an opening 16 on the side of the lower portion of the lower section of the cell which may be provided with a stop cock 17. The combination of the opening and the stop cock allows removal and recovery of the denser product solutions from the electrolytic cell.

In the embodiment illustrated in FIG. 1, the cathode 12 is positioned in the upper section of the electrolytic cell in order to provide a distance between the cathode 12 and the anode which comprises the metal fragments 13. In one embodiment, the distance between the cathode 12 and the metal fragments 13 should be sufficient to minimize if not prevent the plating of the metal onto the cathode 12 which could significantly reduce the effectiveness and life of the cathode 12. In addition, the positioning of the electrode near the top of the upper section of cell 10 insures that any agitation of the solution inadvertently caused by the formation and movement of hydrogen gas bubbles around the cathode 12 will not be transmitted to the more dense solutions of the desired metal sulfonate contained in the lower section of the electrolytic cell 10. The electrolysis conducted in cell 10 may be either batchwise or continuous or semi continuous. Thus, as the desired concentrated metal sulfonate solution is withdrawn and recovered through opening 16 and stop cock 17, an equivalent amount of fresh sulfonic acid can be added through the upper section of the cell.

In another embodiment not shown in FIG. 1, the bottom surface 19 of cathode 12 may be parallel to the surface 20 of solution 14 (i.e., $\theta=0°$). When the bottom surface 19 of cathode 12 is parallel or almost parallel to the surface 20 of solution 14, some of the hydrogen gas generated at or near the bottom surface 19 of cathode 12 may accumulate below the cathode and form a layer or pocket of hydrogen gas which may reduce the amount of electrolyte (the aqueous solution of organic sulfonate) in contact with the electrode and result in a reduction in the current. Accordingly, care should be taken to ensure that the accumulation of hydrogen gas is not sufficient to reduce the electrolytic reaction to unacceptable levels.

In the embodiment illustrated in FIG. 1, cathode 12 is shown extending across a portion to the cell 10. In another embodiment, cathode 12 may extend almost across the cell provided that there is sufficient space between the cathode and the sides of the cell 10 to allow addition of fresh organic sulfonate solution, removal of the desired concentrated metal sulfonate, and the escape of hydrogen bubbles formed at the cathode. Thus, in one embodiment using a round container for the electrolytic cell, the cathode may comprise a round sheet of material with a diameter smaller than the internal diameter of the round container thereby providing openings for the hydrogen gas to escape from the cell, and for adding fresh organic sulfonate solution.

The anode 13 used in the embodiment of FIG. 1 and in other embodiments described herein comprises a metal which is the same as the metal of the desired metal sulfonate. Thus if a tin sulfonate is desired, tin is used as the anode 13 in cell 10 of FIG. 1. When a lead sulfonate is the desired product, lead is used for anode.

Various materials which have been used as cathodes in electrolytic cells can be included as cathodes in the cells of the invention. Cathode materials include graphite, iron, stainless steel, nickel plated titanium, tin, zinc, cadmium, nickel, lead, copper, or alloys thereof, mercury, mercury amalgous, etc. The term "alloy" is used in a broad sense and includes intimate mixtures of two or more of the metals, as well as one metal coated onto another metal. Mercury amalgous cathodes include, for example, mercury on nickel, mercury on copper, mercury on cadmium, mercury on zinc, etc. In one embodiment, the cathode metal is the same as the metal being dissolved at the anode to form the desired metal sulfonate.

In the embodiment illustrated in FIG. 1, the anode comprises the metal fragments 13 which are connected to a power source by wire 11. In another embodiment the fragments can be replaced by a sheet of the metal. In yet another embodiment, the metal fragments or metal sheet may be connected to a power source using a normal electrode rod or wire which is in contact with the metal sheet or fragments on the bottom of the cell, and the electrode rod or wire extends out through the upper section of the cell. Various materials normally used as anodes in electrolytic cells may be used in this embodiment of the present invention such as graphite, stainless steel, tin, etc. If the rod or wire is composed of metals such as tin or lead that dissolve during electrolysis, they may be protected by wrapping with materials such as teflon.

In operation an aqueous solution of an organic sulfonic acid is charged to the cell 10. The amount of the aqueous solution charged to the cell should be sufficient to cover the cathode positioned in the upper section of the cell. A DC power supply (not shown) is connected to both the anode and the cathode, and a current is passed through the cell thereby producing the desired metal sulfonate. The current utilized in the electrolysis may range from about 1 to about 25 amps, and is more often within the range of from about 5 to about 15 amps. The electrode voltage may range from about 0.5 to about 20V, and is more often within the range of from about 3 to about 10V. The current is applied to the cell for a period of time which is sufficient to result in the formation of the desired metal sulfonate at a desired concentration. There is no circulation of the solution within the cell by pumps, and there is no significant circulation of the solution by gas evolution since it is desired to have the more dense, more concentrated metal sulfonate solutions accumulate at or near the bottom of the reactor.

The temperatures of the electrolytic solution within the electrolytic cell may range from about 10 to about 70° C. and is more often in the range of from about 25 to about 50° C. The electrolytic solution may be cooled or heated as required. Thus, in one embodiment, a heating coil may be inserted into the electrolytic solution. Care should be taken however, to avoid any internal agitation or stirring of the electrolytic solutions within the cell. The electrolysis conditions and operation procedures may optionally be modified depending upon the metal being dissolved and the sulfonate being utilized in the electrolytic cell.

As the electrolytic process proceeds in the cell, the metal which is positioned at the bottom of the cell dissolves and produces the desired metal salt of the organic sulfonic acid. The product which is obtained from the electrolysis comprises an aqueous solution containing the desired metal sulfonate, free sulfonic acid, and water. As the concentration of the desired metal sulfonate increases, the density of the product solution increases and the heavier solution accumulates on the bottom of the reactor. It has been observed that there is a density gradient within the cell with the greater density material being concentrated near the bottom of the cell, and the density decreases as the distance from the bottom of the cell increases. Accordingly, as the electrolysis proceeds, highly concentrated solutions of the metal sulfonates can be withdrawn from the bottom of the cell such as, for example by removing the concentrated solution from the bottom of the cell through opening 16 and stop cock 17. The electrolytic procedure can be conducted in a batchwise or continuous manner.

In another embodiment of the invention, the electrolytic cell does not contain opening 16 and stop cock 17. The desired concentrated aqueous solution of metal sulfonate can be removed from the bottom of the electrolytic cell via a product extraction tube inserted into the cell through the top of the cell and extending down to the bottom of the cell where the desired concentrated metal sulfonate solution accumulates.

The electrolytic process can be conducted in a batchwise, semi-continuous, or continuous manner. For example, the metal sulfonate product solution can be withdrawn through opening 16 and stop cock 17 as the electrolysis reaction proceeds, and fresh organic sulfonic acid can be added to the top of the cell, preferably without causing any substantial agitation of the solution within the cell.

It has been discovered that the above described electrolysis reaction occurs without the addition of any promoters such as air or oxygen bubbled through the electrolysis solution, and that no structure (e.g., membrane) is required to structurally separate the anode from the cathode. Moreover, the aqueous solution of the organic sulfonic acid charged to the electrolytic cell is free of any water soluble salt of a strong inorganic acid with a strong inorganic base. An example of such a salt is an alkali metal halide.

In order to achieve the highest possible reaction rate, in one embodiment, the metal anode which is positioned at the bottom of the cell comprises metal pieces or fragments having a large surface area. Thus, the fragments may comprise beds of powder shot, granules, needles turnings, wire, rods globules, etc. Generally, the metal desirably has a purity of at least 99% in order to minimize impurities in the desired metal sulfonate.

The type of electrolytic cell used in the processes of the present invention may be any of the known electrolytic cells. The cells may be composed of conventional cell materials which are compatible (and inert) with the materials being charged into or being formed in the cells.

In one embodiment, the organic sulfonic acids which are utilized in the present invention may be represented by the following formula I.

$$RSO_3H \qquad \text{I}$$

wherein R is an alkyl group or an alkenyl group containing from about 1 to about 12 carbon atoms, a hydroxylalkyl group containing from 1 to about 12 carbon atoms, or an aryl group containing from 6 to about 12 carbon atoms. The alkyl groups and the hydroxy alkyl groups represented by R may be straight chain or branched. The alkyl or alkenyl groups, in one embodiment, may contain from 1 to about 6 carbon atoms, and in another embodiment, from about 1 to about 5 carbon atoms. Examples of alkane sulfonic acids include, for example, methane sulfonic acid, ethane sulfonic acid, propane sulfonic acid, 2-propane sulfonic acid, butane sulfonic acid, 2-butane sulfonic acid, pentane sulfonic acid, hexane sulfonic acid, decane sulfonic acid, and dodecane sulfonic acid. Mixtures of any of the above-identified alkane sulfonic acids can be utilized in the methods of the invention. Examples of aromatic sulfonic acids (where R is an aryl group) include benzenesulfonic acid, toluenesulfonic acid, xylenesulfonic acid, p-nitrobenzenesulfonic acid, p-phenolsulfonic acid, etc.

The alkanol sulfonic acids may be represented by the following Formula II:

$$C_nH_{2n+1}\text{—}CH(OH)\text{—}CH_2)_m\text{—}SO_3H \qquad \text{(II)}$$

wherein n is from 0 to about 10, m is from 1 to about 11 and the sum of m+n is from 1 up to about 12. As can be seen from the above Formula II, the hydroxy group may be a terminal or internal hydroxy group. Examples of useful alkanol sulfonic acids include 2-hydroxy ethyl-1-sulfonic acid, 1-hydroxy propyl-2-sulfonic acid, 2-hydroxy propyl-1-sulfonic acid, 3-hydroxy propyl-1-sulfonic acid, 2-hydroxy butyl-1-sulfonic acid, 4-hydroxy butyl-1-sulfonic acid, 2-hydroxy-pentyl-1-sulfonic acid, 4-hydroxy-pentyl-1-sulfonic acid, 2-hydroxy-hexyl-1-sulfonic acid, 2-hydroxy decyl-1-sulfonic acid, 2-hydroxy dodecyl-1-sulfonic acid.

Alkane sulfonic acids and alkanol sulfonic acids are available commercially and can also be prepared by a variety of methods known in the art. One method comprises the catalytic oxidation of mercaptans or aliphatic sulfides having the formula $R_1S_nR_2$ wherein $R_1$ or $R_2$ are alkyl groups and n is a positive integer between 1 and 6. Air or oxygen may be used as the oxidizing agent, and various nitrogen oxides can be employed as catalysts. The oxidation generally is effected at temperatures below about 150° C. Such oxidation processes are described and claimed in U.S. Pat. Nos. 2,433,395 and 2,433,396.

The electrolytic process of the present invention can be utilized to prepare a variety of metal salts of various organic sulfonic acids. The method of the invention is useful particularly for preparing metal salts wherein the metals do not normally react with the organic sulfonic acid absent some external force such as a promoter, catalyst, etc. Metals which are particularly useful in preparing metal sulfonates in accordance with the method of the present invention include copper, nickel, zinc, lead, tin and the precious metals such as platinum, palladium, silver, gold, iridium, rhodium, osmium, and ruthenium.

The following Examples illustrate the method of the invention unless otherwise indicated in the Examples, in the claims, or elsewhere in the written description, all parts and percentages are by weight, temperatures are in degrees centigrade, and pressure is at or near atmospheric.

EXAMPLE 1

Tin shot (4 kg) is charged to a 4 liter reaction kettle, and a teflon tape wrapped tin rod is inserted into the kettle with one tip of the rod in contact with the tin shot at the bottom of the kettle. A cooling coil is positioned around the teflon tape wrapped tin rod. The tin rod and tin shot serve as the anode in the electrolytic cell. A graphite cathode is positioned near the top of the kettle. Aqueous methane sulfonic acid solution (about 45% by weight of tin methane sulfonate) is added to the kettle in an amount which substantially fills the kettle and covers the cathode. A product removal glass tube is inserted into the kettle, and the tube extends to the lower section of the kettle and into the tin shot.

The anode and cathode are connected to a power source, and electrolysis is carried out applying a DC voltage to the anode and cathode. Initially, 8 volts are applied for a current of about 15–17 amps. This results in an increase of the temperature of the solution within the vessel. The current is reduced to 8 amps (5 volts applied) and the electrolysis is conducted for 8 hours without any need for cooling. Hydrogen is evolved at the cathode is allowed to escape to the atmosphere. At the end of this period, tin methane sulfonate solution is recovered from the bottom of the vessel and from the area on top of the tin shot utilizing the product removal glass tube. The density of the product solution recovered from the bottom of the kettle is 1.6, and the density of the tin methane sulfonate solution at the top of the tin shot in the bottom of the vessel is 1.26.

EXAMPLE 2

A 4 liter reaction kettle is provided with 2136 grams of tin shot (Alfa Aesar), which sits on the bottom of the vessel; a teflon wrapped tin rod (anode) which extends down into the kettle and is in contact with the tin shot; an internal cooling coil which is wrapped with teflon; a graphite cathode near the top of the kettle; and a glass product removal tube which extends into the tin shot which is located at the bottom of the kettle. The kettle is filled with an aqueous solution of methane sulfonic acid containing 45% by weight of methane sulfonic acid, and the amount of methane sulfonic acid solution in the kettle is sufficient to cover the graphite cathode. Electrolysis is conducted at 8 amps. The voltage varies from about 5.6 to about 7, and the temperature of the solution within the vessel (without internal cooling) is maintained at from about 40–45° C. After about 4.5 hours, a sample of tin methane sulfonate solution is recovered from the bottom of the kettle through the product removal tube, and the density is determined to be 1.62. Samples of the product tin methane sulfonate solution also are removed from the bottom of the kettle after 7 and 8 hours of electrolysis, and the densities of these solutions are observed to be 1.66 and 1.69 respectively. As samples of the product solution are removed from the kettle, equivalent make up quantities of the methane sulfonic acid solution are added to the top of kettle.

After 8 hours, the electrolysis reaction is terminated and the liquid within the kettle is allowed to cool overnight. The procedure (electrolysis followed by overnight cooling) is repeated for 10 additional days with periodic removal of the desired tin methane sulfonate solution from the bottom of the reactor, and replacement of the spent methane sulfonic acid by addition of the methane sulfonic acid at the top of the kettle. The densities of the thus recovered tin methane sulfonate solutions range from 1.65 to 1.68.

EXAMPLE 3

The apparatus and the procedure utilized in this example is substantially the same as in Example 2 except that the cathode is a 2.54 $in^2$ tin plate having a thickness of 0.13 inch and a weight of 349.4 grams; the tin rod used as part of the anode is 0.5 inch in diameter; and the amount of tin shot charged to the kettle is 3000 g. The electrolysis is conducted at 8 amps with the voltage varying from 4.4 to about 5.6. After 8 hours of electrolysis, a sample of the tin methane sulfonate recovered from the bottom of the bed of tin has a density of 1.55. The density of a sample recovered from just above the bed of tin is 1.21. The electrolysis is continued, and after a total period of 22 hours, a sample of the tin methane sulfonate recovered from the bottom of the bed of tin is 1.76, and the density of a solution recovered from just above the tin bed is 1.33. At the end of the electrolysis, the weight of the tin plate used as the cathode is 349.3 grams, and the weight of the tin shot is 2709 g.

The present invention provides a convenient and direct method of preparing concentrated solutions of metal sulfonates by electrolysis. Promoters such as oxygen, air, salts such as sodium chloride, inorganic acids such as hydrochloride, or mixtures thereof are not required, and the solutions within the electrolytic cell are free of such materials. Accordingly, highly concentrated metal sulfonates are produced by the method of the invention which are free of such impurities.

While the invention has been explained in relation to its various embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A method for preparing a metal sulfonate by electrolysis which comprises:

(A) providing a membraneless electrolytic cell having an upper section and a lower section, and comprising:
  (i) a metal anode positioned in the lower section of the electrolytic cell, and
  (ii) a cathode positioned in the upper section of the electrolytic cell, (B) charging to the cell, an aqueous solution of an organic sulfonic acid, (C) passing a current through the cell whereby the metal of the anode dissolves in the sulfonic acid and forms the desired metal sulfonate, (D) accumulating the metal sulfonate in a lower portion of the lower section of the cell, and (E) recovering an aqueous solution of the desired metal sulfonate from the lower portion of the lower section of the cell.

2. The method of claim 1 wherein the aqueous solution of metal sulfonate recovered in (E) contains from about 40% to about 70% by weight of the metal sulfonate.

3. The method of claim 1 wherein the aqueous solution of metal sulfonate recovered in (E) contains from about 50% to about 65% by weight of the metal sulfonate.

4. The method of claim 1 wherein the sulfonic acid is represented by the formula $$RSO_3H \qquad \text{I}$$

wherein R is an alkyl or alkenyl group containing from 1 to about 12 carbon atoms, a hydroxyalkyl group containing from 1 to about 12 carbon atoms, or an aryl group containing from 6 to about 12 carbon atoms.

5. The method of claim 1 wherein the sulfonic acid is an alkane sulfonic acid represented by the formula $$RSO_3H \qquad \text{I}$$

wherein R is an alkyl group containing from 1 to 5 carbon atoms.

6. The method of claim 1 wherein the sulfonic acid is an alkanol sulfonic acid represented by the formula $$CnH_{2n+1}CH(OH)(CH_2)m\text{-}SO_3H \qquad \text{II}$$

wherein n is from 0 to about 10, m is from about 1 to about 11, and the sum of n+m is from 1 to about 12.

7. The method of claim 1 wherein the metal is selected from precious metals, copper, nickel, zinc, lead, tin, and mixtures thereof.

8. The method of claim 1 wherein the metal is selected from copper, nickel, zinc, lead and tin.

9. The method of claim 1 wherein the metal is tin.

10. The method of claim 1 wherein, after the initial charge in (B), an aqueous solution of the sulfonic acid id added to the upper section of the cell as the aqueous solution of the metal sulfonate is recovered from the lower portion of the lower section of the cell.

11. The method of claim 1 wherein the concentration of the sulfonic acid in the aqueous solution charged to the cell is from about 20% to about 70% by weight.

12. The method of claim 1 wherein the current is a direct current.

13. A method for preparing a metal salt of an alkane sulfonic acid by electrolysis wherein the metal is copper, nickel, zinc, lead, or tin and wherein the method comprises:

(A) providing a membraneless electrolytic cell having an upper section and a lower section, and comprising:
  (i) an anode comprising the metal positioned in the lower section of the electrolytic cell, and
  (ii) a cathode positioned in the upper section of the electrolytic cell, (B) charging to the cell, an aqueous solution of an alkyl sulfonic acid, (C) passing a current through the cell whereby the metal of the anode dissolves in the sulfonic acid and forms the desired metal salt, (D) accumulating the metal salt in a lower portion of the lower section of the cell, and (E) recovering an aqueous solution of the desired metal salt from the lower portion of the lower section of the cell.

14. The method of claim 13 wherein the aqueous solution of metal sulfonate recovered in (E) contains from about 40% to about 70% by weight of the metal sulfonate.

15. The method of claim 13 wherein the aqueous solution of metal sulfonate recovered in (E) contains from about 50% to about 65% by weight of the metal sulfonate.

16. The method of claim 13 wherein the sulfonic acid is an alkane sulfonic acid represented by the formula $$RSO_3H \qquad \text{I}$$

wherein R is an alkyl group containing from 1 to 5 carbon atoms.

17. The method of claim 13 wherein the sulfonic acid is methane sulfonic acid.

18. The method of claim 13 wherein the metal is tin.

19. The method of claim 13 wherein an aqueous solution of the sulfonic acid is added to the upper section of the cell as the aqueous solution of the metal sulfonate is recovered from the lower portion of the lower section of the cell.

20. The method of claim 13 wherein the concentration of the sulfonic acid in the aqueous solution charged to the cell is from about 30% to about 60% by weight.

21. The method of claim 13 wherein the current is a direct current.

22. The method of claim 13 wherein there is no agitation of the solutions in the cell.

23. A method for preparing tin methane sulfonate by electrolysis which comprises:

(A) providing a membraneless electrolytic cell having an upper section and a lower section, and comprising:

(i) a tin anode positioned in the lower section of the electrolytic cell, and (ii) a cathode positioned in the upper section of the electrolytic cell, (B) charging to the cell, an aqueous solution of methane sulfonic acid, (C) passing a direct current through the cell whereby the tin dissolves in the methane sulfonic acid and forms the desired tin methane sulfonate, (D) accumulating the tin methane sulfonate in a lower portion of the lower section of the cell, and (E) recovering an aqueous solution of tin methane sulfonate from the lower portion of the lower section of the cell.

24. The method of claim 23 wherein the aqueous solution of metal sulfonate recovered in (E) contains from about 40% to about 70% by weight of the metal sulfonate.

25. The method of claim 23 wherein the aqueous solution of metal sulfonate recovered in (E) contains from about 50% to about 65% by weight of the metal sulfonate.

26. The method of claim 23 wherein, after the initial charge to the cell in (B), additional methane sulfonic acid is added to the upper section of the cell as the aqueous solution of tin methane sulfonate is recovered from the lower portion of the lower section of the cell in (E).

27. The method of claim 23 wherein the concentration of the aqueous methane sulfonic acid charged to the cell is from about 30% to about 60% by weight.

28. The method of claim 23 wherein there is no agitation of the solutions within the cell.

* * * * *